US006386928B2

(12) United States Patent
Kitamura

(10) Patent No.: US 6,386,928 B2
(45) Date of Patent: May 14, 2002

(54) ELECTRICAL CONTACT

(75) Inventor: Hiroshi Kitamura, Kanagawa (JP)

(73) Assignee: Tyco Electronics. AMP, K.K., Kanagawa (JP)

( * ) Notice: Subject to any disclaimer, the term of this patent is extended or adjusted under 35 U.S.C. 154(b) by 0 days.

(21) Appl. No.: 09/813,417

(22) Filed: Mar. 21, 2001

(30) Foreign Application Priority Data

Mar. 23, 2000 (JP) ..... 2000-082858

(51) Int. Cl.[7] ..... H01R 11/22
(52) U.S. Cl. ..... 439/852; 439/856
(58) Field of Search ..... 439/851, 852, 439/856, 857, 858, 861, 862

(56) References Cited

U.S. PATENT DOCUMENTS

| | | | | | |
|---|---|---|---|---|---|
| 4,564,259 A | | 1/1986 | Vandame | 439/852 |
| 4,564,433 A | * | 1/1986 | Vandame | 439/852 |
| 5,443,592 A | * | 8/1995 | Ittah et al. | 439/851 |
| 5,611,717 A | | 3/1997 | Joly | 439/857 |
| 5,630,738 A | * | 5/1997 | Ito et al. | 439/852 |
| 5,735,717 A | * | 4/1998 | Nabeshima | 439/851 |
| 6,024,612 A | * | 2/2000 | Myer et al. | 439/852 |
| 6,042,453 A | * | 3/2000 | Chen | 439/852 |
| 6,203,385 B1 | * | 3/2001 | Sato et al. | 439/852 |

FOREIGN PATENT DOCUMENTS

| | | | |
|---|---|---|---|
| EP | 0 887 885 A2 | 12/1998 | H01R/13/11 |
| JP | 7-296886 | 11/1995 | H01R/13/533 |
| JP | 10-149855 | 6/1998 | H01R/13/11 |
| JP | 10-189102 | 7/1998 | H01R/13/11 |
| WO | WO 98/29924 | 7/1998 | H01R/13/115 |

* cited by examiner

*Primary Examiner*—Trisida C Patel

(57) ABSTRACT

The electrical contact 1 has a contact member 16 that contacts the mating contact T. The contact member 16 has a first resilient contact arm 16*a* which extends rearward from the lower top wall 15, a connecting section 16*b* which is bent downward at the rear end of the first resilient contact arm, and a second resilient contact arm 16*c* which extends forward from the connecting section 16*b*. In cases where the mating contact T tends to be pushed further inward after the insertion of the mating contact T has been completed, the area in the vicinity of the rear end of the first resilient contact arm 16*a* contacts the upper top wall 14.

3 Claims, 6 Drawing Sheets

ELECTRICAL CONTACT

FIELD OF THE INVENTION

The present invention relates to an electrical contact which is used to prevent microrubbing wear.

BACKGROUND

Electrical connectors used in automobiles may be subjected to vibration depending on the use of the connector. When such electrical connectors vibrate, microrubbing occurs between the electrical contacts and their respective mating contacts. As a result of this microrubbing, wear occurs between the contacts, causing the electrical resistance at the connection to increase.

For example, a known receptacle terminal 100 is shown in FIG. 5 and disclosed in Japanese Patent Application Kokai No. HEI 7-296886. This receptacle consists of an inner body 110, and an outer body 130. The inner body 110 is equipped with a contact member 111 which has an elastic contact section 112 that contacts the mating contact (not shown in the figures), a wire receiving section 113, and a spring 116 which is formed between the contact member 111 and the wire receiving section 113. The wire receiving section 113 consists of a wire barrel 114 and an insulation barrel 115. A projection 125 is formed so that it protrudes from the bottom wall 117 of the inner body 110 at a point located further toward the wire receiving section 113 than the spring 116. This projection 125 engages with an opening (not shown in the figures) formed in the bottom wall of the outer body 130 to fasten the inner body 110 and outer body 130 together. The spring 116 is constructed from a plurality of elastic girders 123 separated by a plurality of slots 119, 120, 121 and 122 which extend through the bottom wall 117 and side walls 118, so that the spring 116 has elasticity in the axial direction. The respective elastic girders 123 are connected by bridge parts 124 that are deformable in the plane of the side walls 118.

This receptacle terminal 100 is inserted into a connector housing (not shown in the figures), and is anchored to this connector housing by lances 131 formed on the side walls of the outer body 130. In this case, as a result of the presence of the spring 116, the contact member 111 of the inner body 110 can be freely and independently moved in the axial direction. In cases where the connector is subjected to vibration, the outer body 130 and the portion of the inner body 110 that is located further toward the wire receiving section 113 than the spring 116 vibrate. However, since this vibration is absorbed by the spring 116, the contact member 111 does not vibrate, so that microrubbing with the mating contact is prevented.

Another example of a known contact is shown in FIG. 6 and disclosed in Japanese Patent Application Kokai No. HEI 10-189102. This electrical contact 200 consists of a receptacle 210 that accommodates a mating contact (not shown in the figures), and a wire receiving section 220 to which an electrical wire is connected. The receptacle 210 is equipped with a top wall 212 which extends from the upper end of one side wall (not shown in the figures) toward the other side wall 211, a connecting part 213 which extends from this second side wall 211 toward the first side wall, and a contact member 214 which extends from the end of the connecting part 213 and contacts the mating contact. Here, the width of the connecting part 213 is set so that it is considerably narrower than the width of the side wall 211. The connecting part 213 is thus constructed so that it has elasticity in the axial direction.

This electrical contact 200 is inserted into a connector housing (not shown in the figures), and a lance formed on the housing engages with an opening in the bottom wall of the receptacle 210, so that the electrical contact 200 is anchored to the connector housing. As a result of the presence of the connecting part 213 which possesses elasticity, the contact member 214 can move freely and independently in the axial direction inside the receptacle 210. In cases where the connector is subjected to vibration, the outside portion of the receptacle 210 vibrates. However, since this vibration is absorbed by the connecting part 213, the contact member 214 does not vibrate, so that microrubbing wear with the mating contact is prevented.

Yet another known electrical contact is shown in FIG. 7 and disclosed in Japanese Patent Application Kokai No. HEI 10-149855. This electrical contact 300 consists of two bodies, an internal body 310 and an external body 320. The internal body 310 has a contact member 311 that contacts the mating contact (not shown in the figures), and a lead part 312 that extends rearward from the rear end portion of the contact member 311. Furthermore, the external body 320 is equipped with an enveloping body 321 that supports the contact member 311 of the internal body 310 so that play is possible in the axial direction, and a wire receiving section 322 which positions the lead part 312 of the internal body 310 on the inside, and to which an electrical wire (not shown in the figures) is connected.

This electrical contact 300 is inserted into a connector housing (not shown in the figures), and a lance formed on the housing engages with an opening in the bottom wall of the enveloping body 321, so that the electrical contact 300 is anchored to the connector housing. The contact member 311 can move freely and independently in the axial direction inside the enveloping body 321, and the lead part 312 possesses flexibility so that it can flex in the axial direction. In cases where the connector is subjected to vibration, the enveloping body 321 and wire receiving section 322 vibrate. However, the contact member 311 does not vibrate, so that microrubbing wear with the mating contact is prevented.

The following problems have been encountered in these known electrical contacts. In the case of the receptacle terminal 100 shown in FIG. 5, the transmission of vibration to the contact member 111 is reduced as a result of the presence of the spring 116. However, since this terminal consists of two bodies, the outer body 130 and inner body 110, there are difficulties in terms of the ease of assembly and manufacture of the contact. Furthermore, since the spring 116 is constructed from a plurality of slender elastic girders 123, an extremely slender conductive path is formed in the spring 116, so that this structure is unsuitable for the flow of a relatively large current.

In the case of the electrical contact 200 shown in FIG. 6, as in the receptacle terminal 100 shown in FIG. 5, the transmission of vibration to the contact member 214 is reduced as a result of the presence of the connecting part 213 which acts as a spring, but a slender conductive path is formed in the connecting part 213.

Similarly, in the case of the electrical contact 300 shown in FIG. 7, as in the receptacle terminal 100 shown in FIG. 5, a slender conductive path is formed in the lead part 312, and since the contact does not consist of a single part, there are difficulties in terms of the ease of assembly and manufacture of the contact.

SUMMARY

The present invention was devised to address these problems. An object of the present invention is to provide an electrical contact which has favorable assembly characteristics and is easily manufacturable, and which can allow the flow of a relatively large current and reduce microrubbing wear without using a spring that reduces the transmission of vibration to the contact member from the outside.

The electrical contact has a contact member that contacts the mating contact. The contact member has a first resilient contact arm which extends rearward from the lower top wall, a connecting section which is bent downward at the rear end of the first resilient contact arm, and a second resilient contact arm which extends forward from the connecting section. In cases where the mating contact tends to be pushed further inward after the insertion of the mating contact has been completed, the area in the vicinity of the rear end of the first resilient contact arm 16*a* contacts the upper top wall.

BRIEF DESCRIPTION OF THE DRAWINGS

The invention will now be described by way of example with reference to the accompanying Figures of which:

FIG. 5 illustrates a know receptacle terminal wherein

FIG. 5 (A) is a perspective view, and

FIG. 5 (B) is a perspective view of the inner body.

DETAILED DESCRIPTION OF THE PREFERRED EMBODIMENT

Figure 1:
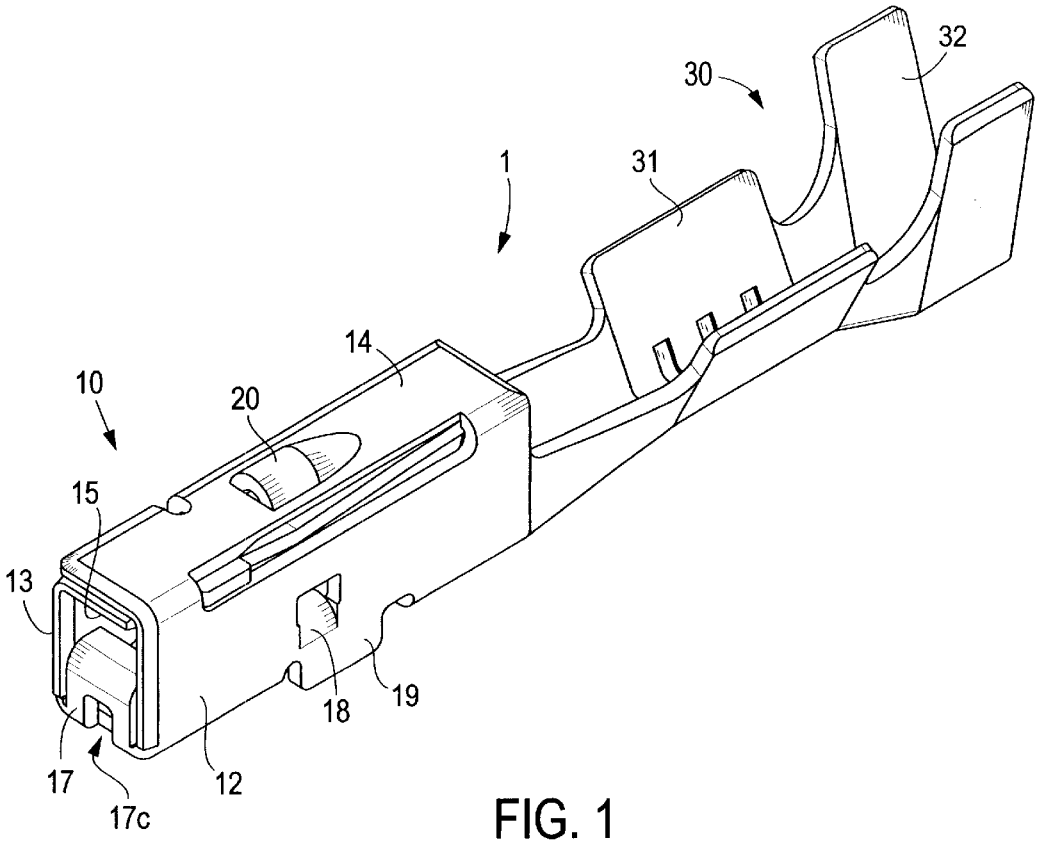
FIG. 1 is a perspective view which illustrates an embodiment of the electrical contact of the present invention.
Figure 2A:
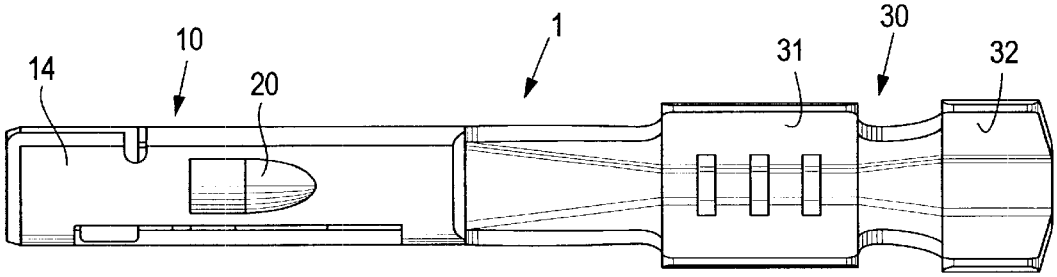
FIG. 2 further illustrates the electrical contact shown in FIG. 1 wherein FIG. 2 (A) is a plan view, FIG. 2 (B) is a front view, and FIG. 2 (C) is a left-side view.
Figure 2B:
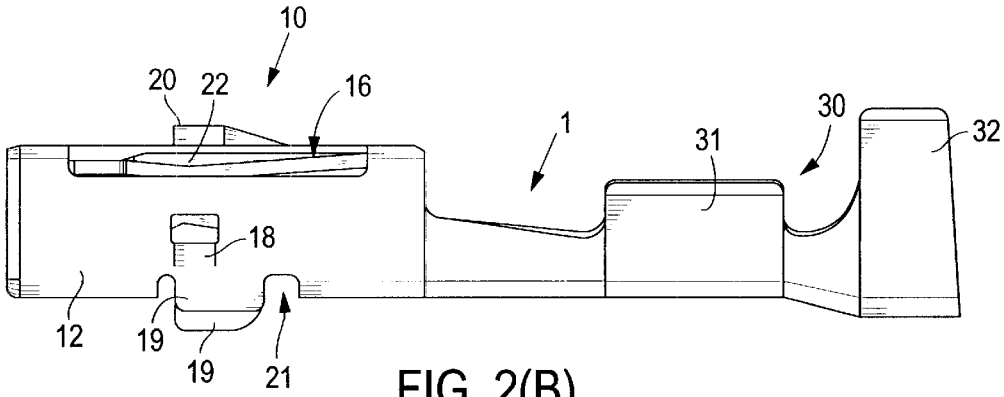
Figure 2C:
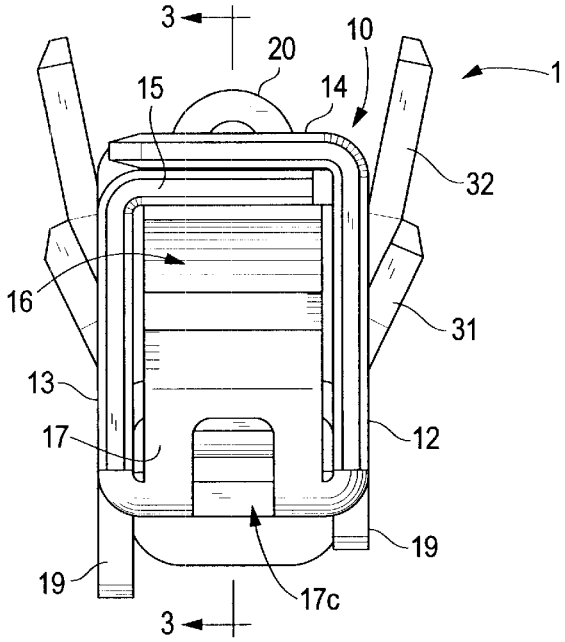
Figure 3:
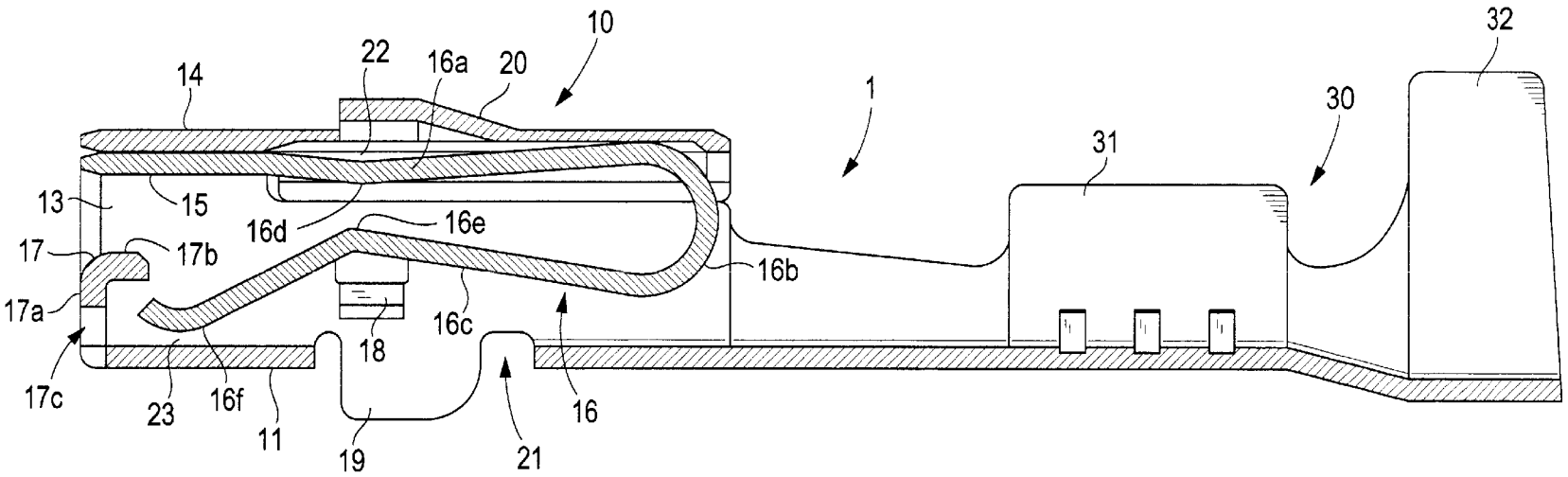
FIG. 3 is a sectional view along line 3—3 in FIG. 2 (C).

The invention will now be described in greater detail. The electrical contact 1 shown in FIGS. 1 through 3 is formed by stamping and bending a metal plate, and is equipped with a receptacle 10 and an wire receiving section 30. This wire receiving section 30 consists of a wire barrel 31 which is crimped onto the core wire of an electrical wire (not shown in the figures), and an insulation barrel 32 which is crimped onto the insulation of this electrical wire.

The receptacle 10 accommodates a male mating contact T (FIG. 4) which is inserted toward the rear from the front. This receptacle 10 is formed as a substantially box-shaped part. It has a bottom wall, a pair of side walls 12 and 13 which are raised from both sides of the bottom wall 11, an upper top wall 14 and a lower top wall 15, each of which extends from one of the sides walls 12 and 13 to overlap each other. The front end surface of this lower top wall 15 coincides with the front end surface of the upper top wall 14, however, the length of the lower top wall 15 is less than the length of the upper top wall 14. A contact member 16 which receives the mating contact T extends rearward from the lower top wall 15.

As is shown most clearly in FIG. 3, this contact member 16 has a first resilient contact arm 16*a* which extends rearward from the lower top wall 15 and contacts the upper surface of the mating contact T. A contact projection 16*d* protrudes from roughly the center portion of the first resilient contact arm 16*a*. The first resilient contact arm 16*a* extends at a slight downward angle from the lower top wall 15 to the contact projection 16*d*, and then extends at a slight upward angle from the contact projection 16*d* to the rear end thereof. The rear end of the first resilient contact arm 16*a* is positioned in the vicinity of the rear end of the receptacle 10, and a connecting section 16*b* which is bent downward is formed on this rear end portion of the first resilient contact arm 16*a*. A second resilient contact arm 16*c* extends forward from the end of the connecting section 16*b*. A contact projection 16*e* is formed so that it protrudes from roughly the center portion of the second resilient contact arm 16*c*. The second resilient contact arm 16*c* extends at a slight upward angle from the end of the connecting section 16*b* to the contact projection 16*e*, and extends at a slight downward angle from the contact projection 16*e* to the free end 16*f* thereof. The undersurface of the free end 16*f* of the second resilient contact arm 16*c* is formed to have an arcuate shape.

Figure 4A:
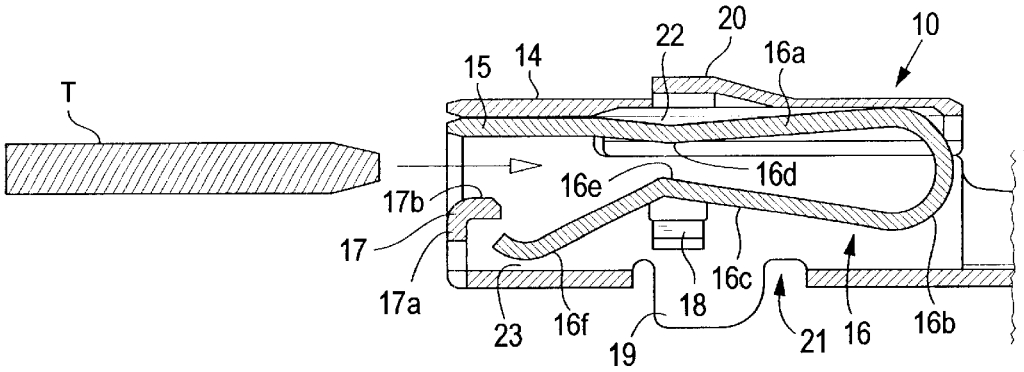
FIG. 4 illustrates the insertion of the mating contact into the electrical contact shown in FIG. 1 wherein FIG. 4 (A) is a partial sectional view prior to the insertion of the mating contact, FIG. 4 (B) is a partial sectional view following the completion of the insertion of the mating contact, and FIG. 4 (C) is a partial sectional view when the mating contact tends to be pushed further inward after the insertion of the mating contact has been completed.
Figure 4B:
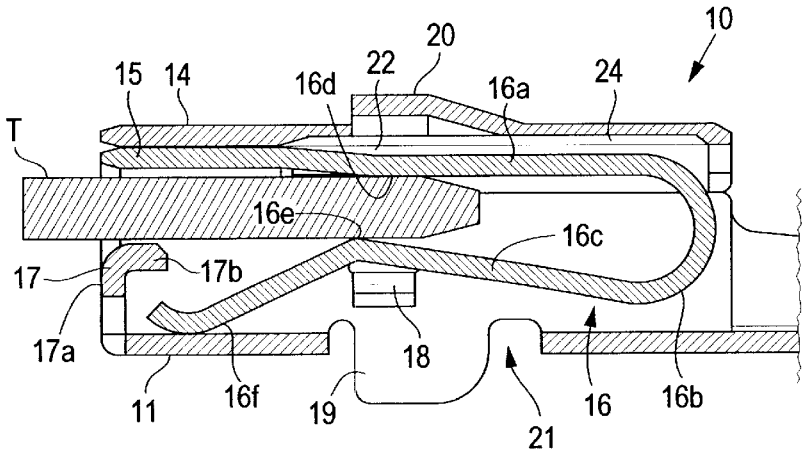
Figure 4C:
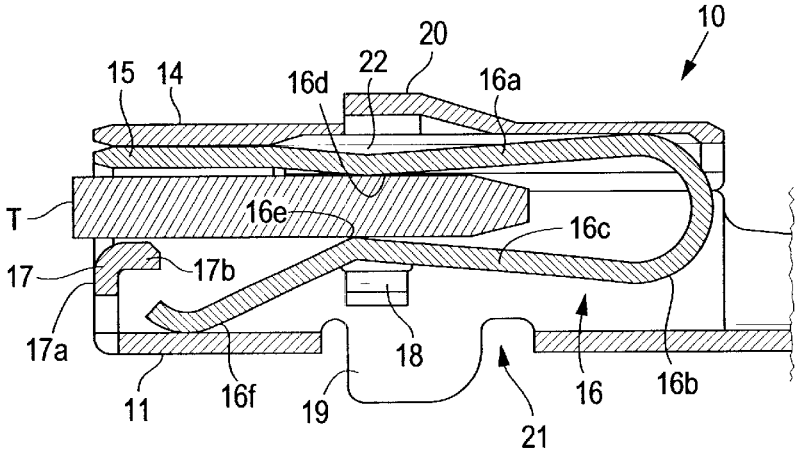
Figure 5A:
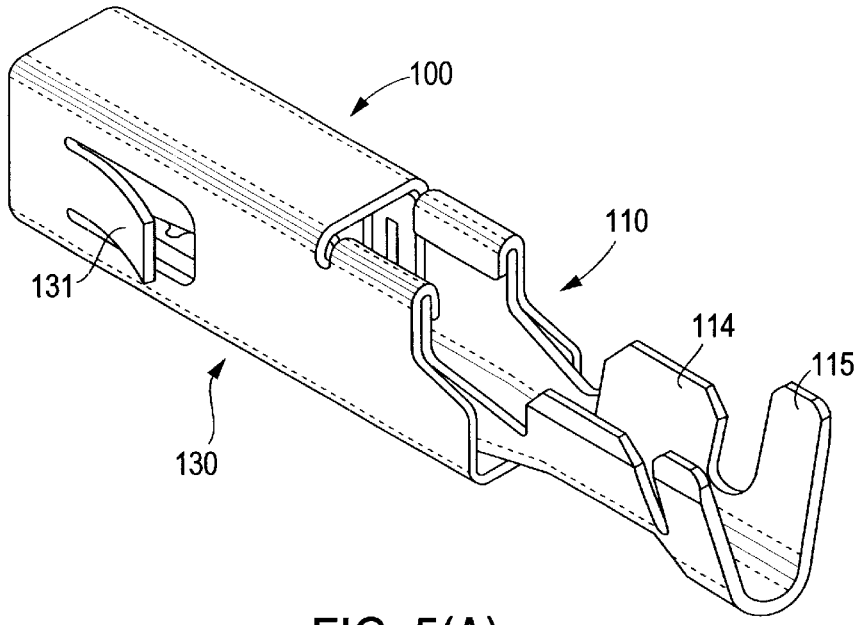
FIG. 5(A) PRIOR ART
Figure 5B:
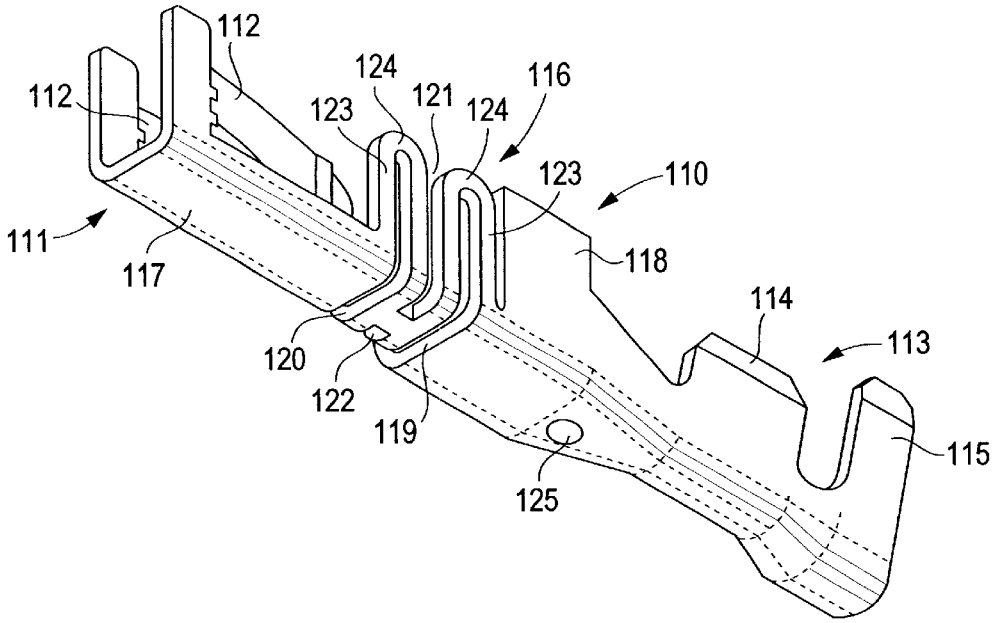
FIG. 5(B) PRIOR ART
Figure 6:
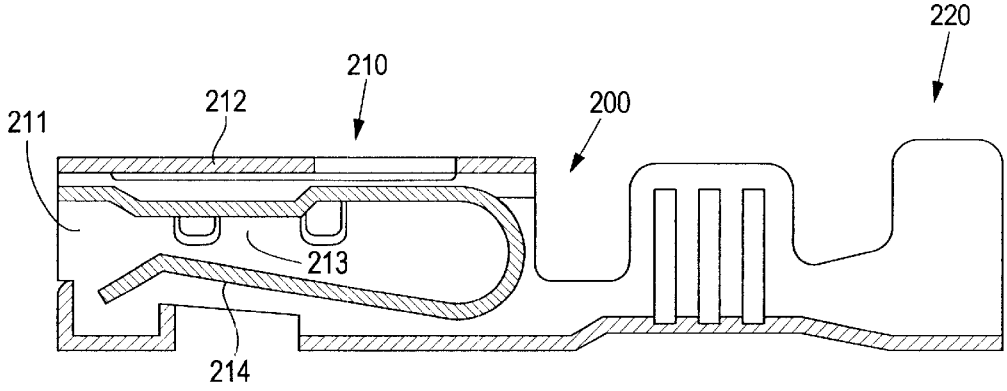
FIG. 6 PRIOR ART
FIG. 6 is a sectional view of another known electrical contact.
Figure 7:
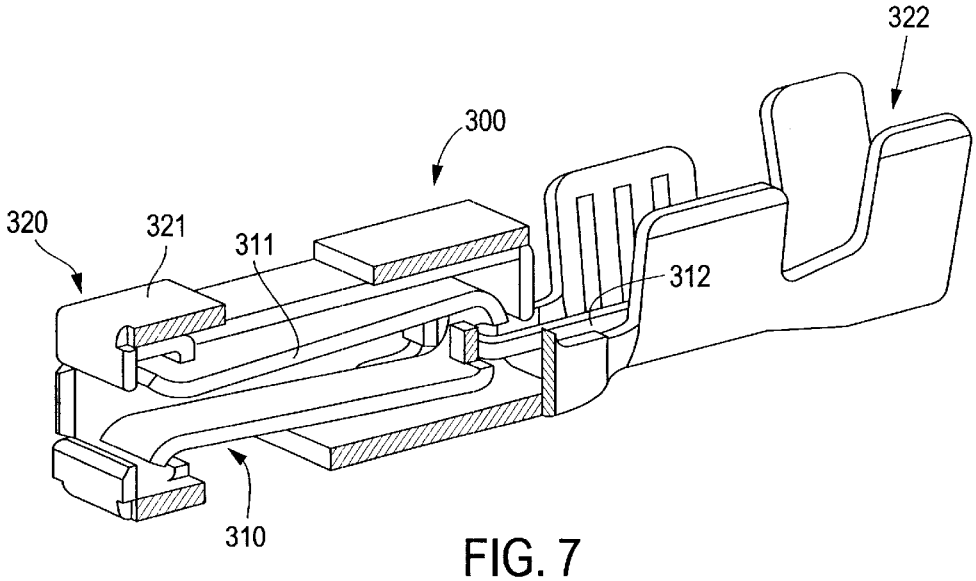
FIG. 7 PRIOR ART
FIG. 7 is a partial sectional perspective view of another known electrical contact.

Prior to the insertion of the mating contact T into the receptacle 10, as is shown in FIG. 3 and FIG. 4 (A), the area in the vicinity of the rear end of the first elastic contact member 16*a* contacts the undersurface of the upper top wall 14, and the intermediate portion of the first resilient contact arm 16*a* is separated from the undersurface of the upper top wall 14 so that a gap 22 is formed. The free end 16*f* of the second resilient contact arm 16*c* is also separated from the bottom wall 11 so that a gap 23 is formed.

Furthermore, as is shown in FIGS. 1 and 3, a lead in tab 17 which substantially covers the free end 16*f* of the second resilient contact arm 16*c* is disposed on the front end of the bottom wall 11. This lead in tab 17 is a substantially L-shaped part which consists of a front wall 17*a* that rises from the front end of the bottom wall 11, and a top wall 17*b* which extends rearward from the upper end of the front wall 17*a*. This lead in tab 17 has the function of protecting the free end 16*f* of the second resilient contact arm 16*c* from the outside, and prevents damage to the second resilient contact arm 16*c* that might be caused by the mating contact T stubbing the free end 16*f*. If the free end 16*f* should be driven upward for some reason, the end of the free end 16*f* is caused to contact the undersurface of the top wall 17*b* of the lead in tab 17, so that the application of an excessive stress to the connecting section 16*b* is prevented. Furthermore, when the mating contact T is inserted into the receptacle 10, the top wall 17*b* of the lead in tab 17 restricts the downward movement of the mating contact T, so that the mating contact T is prevented from contacting the angled part of the second resilient contact arm 16*c* which would cause undesirable plastic deformation of the contact member 16.

A through-hole 17*c* which extends upward from the front end portion of the bottom wall 11 is formed in the front wall 17*a* of the lead in tab 17. This through-hole 17*c* is formed in order to allow the measurement of the gap 23 using a measurement means such as a CCD camera, so that dimensional control can be accomplished.

Referring to FIG. 3, an anti-overstress part 18 contacts the undersurface of the second resilient contact arm 16*c* when the second resilient contact arm 16*c* flexes downward by an excessive amount, and thus prevents any excessive stress from acting on the contact member 16.

The electrical contact 1 shown in FIGS. 1 through 3 is inserted into the contact receiving passage of a connector housing (not shown in the figures), and a lance formed in this passage engages with an opening 21 formed in the bottom wall 11, to secure the contact 1 within the connector housing. Reverse insertion of the electrical contact 1 is prevented by a pair of reverse insertion preventing projections 19 that extend from the side walls 12 and 13, and by the cooperative action of a reverse insertion preventing cutout projection 20 that protrudes from the upper top wall 15 and the contact receiving passage of the connector housing.

Next, the mating sequence will be described with reference to FIG. 4. First prior to the insertion of the mating contact T into the receptacle 10, the area in the vicinity of the rear end of the first resilient contact arm 16*a* contacts the undersurface of the upper top wall 14, and the intermediate portion of the first resilient contact arm 16*a* is separated from the undersurface of the upper top wall 14 so that a gap 22 is formed as shown in FIG. 4 (A). The free end 16*f* of the second resilient contact arm 16*c* is also separated from the bottom wall 11 so that a gap 23 is formed.

Then, when the mating contact T is inserted into the receptacle 10 from the front, the end of the mating contact T contacts the contact projection 16*d* of the first resilient contact arm 16*a* and the contact projection 16*e* of the second resilient contact arm 16*c*. The undersurface of the free end 16*f* of the second resilient contact arm 16*c* also contacts the bottom wall 11. Since the free end 16*f* of the second resilient contact arm 16*c* is separated from the bottom wall 11 prior to the insertion of the mating contact T, so that the second resilient contact arm 16*c* receives no resistive force from the bottom wall 11, the insertion force is minimized.

The mating contact T is then further inserted to a fully mated position as shown FIG. 4 (B). Here, the contact projections 16*d* and 16*e* of the first resilient contact arm 16*a* and second resilient contact arm 16*c* are pushed apart by the mating contact T. As a result, there is a tendency for the second resilient contact arm 16*c* to be straightened forward of the connecting section 16*b*. The connecting section 16*b* is urged downward. As a result, the area in the vicinity of the rear end of the first resilient contact arm 16*a* separates from the upper top wall 14 so that a gap 24 is formed. In this fully mated position, the center part of the first resilient contact arm 16*a* is separated from the upper top wall 14 so that a gap 22 is formed. Furthermore, the free end 16*f* of the second resilient contact arm 16*c* contacts the bottom wall 11 as described above.

In cases where the mating contact T is overinserted, the connecting section 16*b* moves upward and the area in the vicinity of the rear end of the first resilient contact arm 16*a* again contacts the upper top wall 14 as shown in FIG. 4 (C). After the mating contact T has been fully inserted, the coefficient of friction between the mating contact T and the contact member 16 is the coefficient of static friction. Accordingly, the frictional force between the mating contact T and the contact member 16 is greater than the frictional force during the initial stage of insertion. As a result, the contact member 16 is pulled as the mating contact T advances, so that the connecting section 16*b* moves upward. Thus, the area in the vicinity of the rear end of the first resilient contact arm 16*a* contacts the upper top wall 14, so that the contact pressure between the first resilient contact arm 16*a* and the contact projections 16*d* and 16*e* of the second resilient contact arm 16*c*, and the mating contact T, is increased, thus preventing the further advance of the mating contact T.

Accordingly, in cases where the connector is subjected to vibration, the mating contact T tends to be pushed further than the fully inserted position. Since the area in the vicinity of the rear end of the first resilient contact arm 16*a* contacts the upper top wall 14 so that the further advance of the mating contact T is prevented as described above, microrubbing between the first resilient contact arm 16*a* and the contact projections 16*d* and 16*e* of the second resilient contact arm 16*c*, and the mating contact T, can be reduced without using a spring.

Furthermore, in the electrical contact 1, there is no use of a spring that reduces the transmission of vibration from the connector housing to the contact member 16, and there are no locally slender parts throughout the entire body, so that no extremely fine conductive path is formed. Accordingly, the electrical contact can be constructed so that it is suitable for the flow of a relatively large currents. Furthermore, since the electrical contact 1 is formed by stamping and bending a metal plate, and is thus formed by a single part, the assembly characteristics and productivity of the contact are favorable.

What is claimed is:

1. An electrical contact for receiving a mating connector, the contact comprising: a bottom wall, a pair of sidewalls extending from the bottom wall, a top wall connecting the sidewalls;

a contact member extending inward from the top wall, the contact member being configured to have a first contact arm extending from the top wall rearward, a connecting section extending in an arcuate manner from the first contact arm, and a second arm extending forward from the connecting section to form a substantially U-shape into which is received a mating contact;

the first contact arm being spaced apart from the top wall at a central section and being in contact with the top wall near the connecting section, and the second contact arm being spaced apart from the bottom wall when the contact is in an unmated position; the first contact arm moving away from the top wall and the second contact arm contacting the bottom wall upon mating contact insertion; and the first contact arm recontacting the upper wall upon mating contact overinsertion.

2. The electrical contact claimed in claim 1, further comprising a lead in tab having of a front wall extending from a front end of the bottom wall and a top wall that extends rearward from an upper end of the front wall and substantially covers a free end of the second contact arm.

3. The electrical contact claimed in claim 2, further comprising a through-hole formed in the front wall which is used to measure the gap that is formed between the free end of the second contact arm and the bottom wall.

* * * * *